US008505689B2

(12) United States Patent
Plouffe

(10) Patent No.: US 8,505,689 B2
(45) Date of Patent: Aug. 13, 2013

(54) OUTDOOR SUPPORT STRAP AND ASSOCIATED METHOD

(76) Inventor: Richard Henry Plouffe, Cochrane (CA)

( * ) Notice: Subject to any disclaimer, the term of this patent is extended or adjusted under 35 U.S.C. 154(b) by 0 days.

(21) Appl. No.: 13/554,213

(22) Filed: Jul. 20, 2012

(65) Prior Publication Data

US 2013/0025970 A1 Jan. 31, 2013

Related U.S. Application Data

(60) Provisional application No. 61/512,636, filed on Jul. 28, 2011.

(51) Int. Cl.
*A62B 35/00* (2006.01)
*A47K 17/02* (2006.01)

(52) U.S. Cl.
USPC ..... 182/230; 182/9

(58) Field of Classification Search
USPC ..... 182/3, 9, 230
See application file for complete search history.

(56) References Cited

U.S. PATENT DOCUMENTS

| | | | | |
|---|---|---|---|---|
| 7,927,321 | B2 * | 4/2011 | Marland | 604/353 |
| 2003/0005513 | A1 * | 1/2003 | Figueras | 4/483 |
| 2011/0308886 | A1 * | 12/2011 | Stude | 182/9 |

* cited by examiner

*Primary Examiner* — Katherine Mitchell
*Assistant Examiner* — Kristine Florio

(57) ABSTRACT

An outdoor support strap for holding a user in a squatted position above the ground surface while defecating preferably includes a flexible and elongated body suitably sized and shaped to be positioned around a user's waist while being anchored to a support surface such as a tree. The body is preferably formed from an elastic material such that it remains deformably resilient for providing a resistive force against the user's waist. In this manner, the user is able to lean away from the support surface and assume a squatted a position to thereby extend his or her legs forwardly of his or her buttocks. Such a support strap alleviates the strain and energy required to maintain a squatted position for an extended period of time. By using the support strap, the user's hands remain free to hold objects or cleanse the buttocks area with toilet paper for example.

1 Claim, 4 Drawing Sheets

OUTDOOR SUPPORT STRAP AND ASSOCIATED METHOD

CROSS REFERENCE TO RELATED APPLICATIONS

This application claims the benefit of U.S. Provisional Application No. 61/512,636, filed Jul. 28, 2011, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

This non-limiting exemplary embodiment(s) relates generally to support straps and, more particularly, to an outdoor support strap for holding a user in a squatted position above the ground surface while defecating.

2. Prior Art

Maintaining a sanitary condition has always been an inconvenience for outdoor enthusiasts. The lack of access to adequate sanitary facilities and clean water not only makes it burdensome for outdoor enthusiasts to defecate in a sanitary manner, it also forces such individuals to assume an uncomfortable position in order to defecate.

Accordingly, a need remains for an outdoor support strap to overcome the above-noted shortcomings. The non-limiting exemplary embodiment(s) satisfies such a need by providing a an outdoor support strap that is convenient and easy to use, lightweight yet durable in design, versatile in its applications, and designed for easily and conveniently holding a user in a squatted position above the ground surface while defecating.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an outdoor support strap for holding a user in a squatted position above the ground surface while defecating. These and other objects, features, and advantages of the non-limiting exemplary embodiment(s) are provided by an outdoor support strap including a body formed from flexible and elastic material. Such a body is selectively deformed from a circular non-tensioned shape during non-use to an oval tensioned shape when the body is simultaneously positioned around a user waist and a tree. The body further includes a fastener having selectively mated male and female members attached to opposed ends of the body. First and second pads are adjustably attached to unique first and second longitudinal portions of the body, respectively. The body also includes a toilet paper roll holder adjustably mated to a unique third longitudinal portion of the body. In this manner, the first and second pads as well as the toilet paper roll holder are independently and freely displaced along the first, second and third longitudinal portions of body.

In a non-limiting exemplary embodiment, the first, second and third longitudinal extend along a major circumferential length of the body and are mutually exclusive and non-overlapping therealong.

In a non-limiting exemplary embodiment, the toilet paper roll holder includes a lever pivotally engaged with an outer surface of the body and releasably locked between open and closed positions when the lever is respectively articulated away and towards the third longitudinal portion of the body.

In a non-limiting exemplary embodiment, the body further includes flexible first and second rails attached to the outer surface of the third longitudinal portion. In this manner, the lever is slidably engaged with the first and second rails such that the lever is reciprocated along an arcuate path defined along the third longitudinal portion of the body.

In a non-limiting exemplary embodiment, the first pad extends beyond top and bottom edges of the first longitudinal portion of the body and thereby spans across an entire width of the first longitudinal portion transverse to the circumferential length of the body.

In a non-limiting exemplary embodiment, the second pad covers an entire surface area of the second longitudinal portion and is diametrically opposed from the first pad.

In a non-limiting exemplary embodiment, the lever is intermediately positioned between the first and second rails. Thus, the lever has a longitudinal length terminating prior to reaching proximal and distal ends of each of the first and second rails, respectively.

The present disclosure further describes a method of utilizing an outdoor support strap for holding a user in a squatted position above a ground surface while the user defecates. Such a method includes a plurality of chronological steps. Initially a user obtains a body formed from flexible and elastic material wherein the body includes a fastener including selectively mated male and female members attached to opposed ends of the body, first and second pads adjustably attached to unique first and second longitudinal portions of the body respectively, and a toilet paper roll holder adjustably mated to a unique third longitudinal portion of the body. The first and second pads span across an interior side of the body while the toilet paper roll holder remains situated along an exterior side of the body.

The method further includes the chronological steps of: selectively deforming the body from a circular non-tensioned shape during non-use to an oval tensioned shape by simultaneously positioning the body around a user waist and a tree; independently and freely displacing the first and second pads as well as the toilet paper roll holder along the first, second and third longitudinal portions of body; leaning back into a squatted position such that the body supports a user buttock region at an elevated position above the ground surface; defecating; leaning forward into an upright position and opening the fastener; and removing the body from the user waist and the tree.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
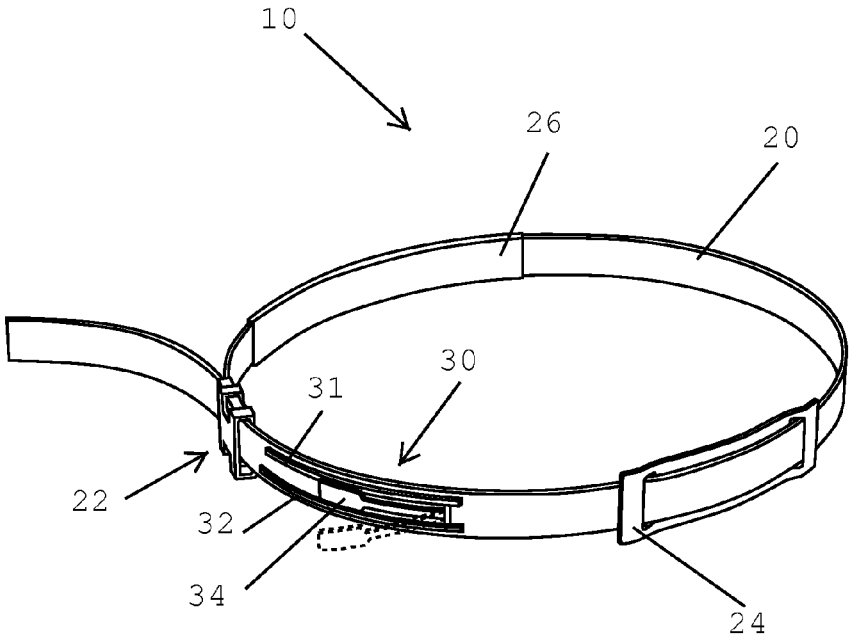
FIG. 1 is a perspective view showing a perspective view showing a strap for holding a user above a ground surface while defecating, in accordance with the non-limiting exemplary embodiment(s)
Figure 2:
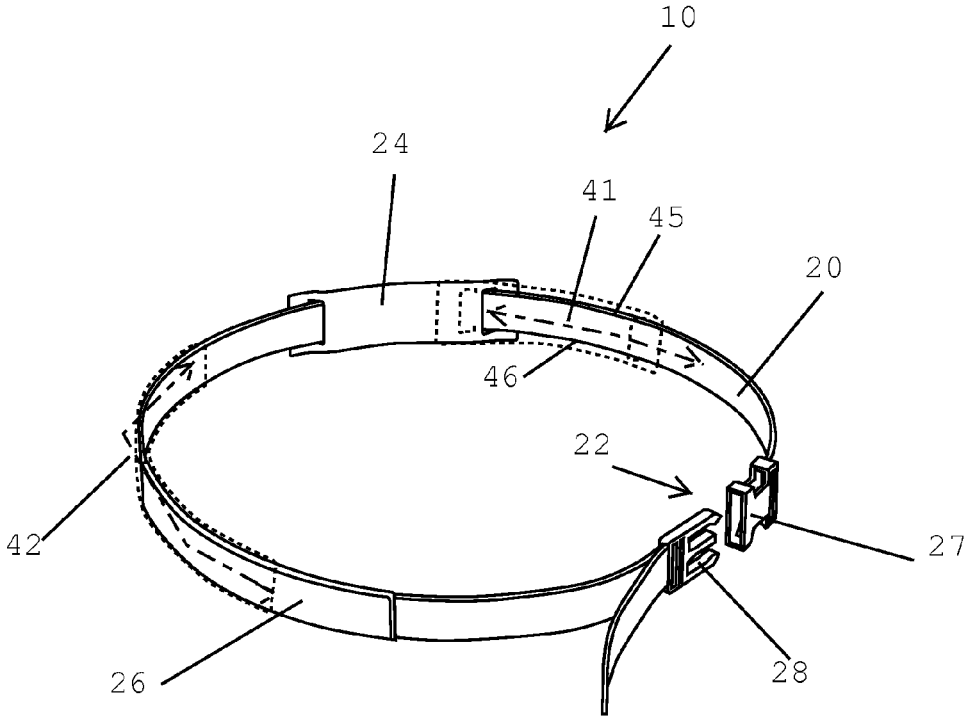
FIG. 2 is a perspective view showing the strap of FIG. 1 at an opened position.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment (s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment (s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary emboidment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The non-limiting exemplary embodiment(s) is/are referred to generally in FIGS. 1-4 and is/are intended to provide an outdoor support strap 10 for holding a user 50 in a squatted position above the ground surface while defecating. It should be understood that such non-limiting exemplary embodiment (s) may be used to hold a male or female user in a squatted position above the ground surface while defecating or a female user while urinating (interchangeably referred to as defecating), and should not be limited to the uses described herein.

Figure 3:
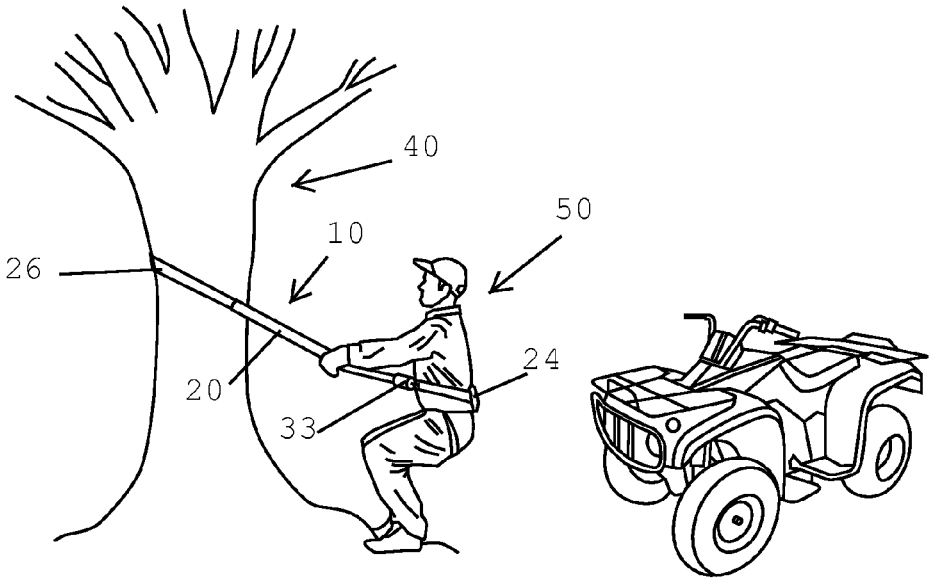
FIG. 3 is a side elevational view showing the strap of FIG. 1 supporting a user above a ground surface during defecation.
Figure 4:
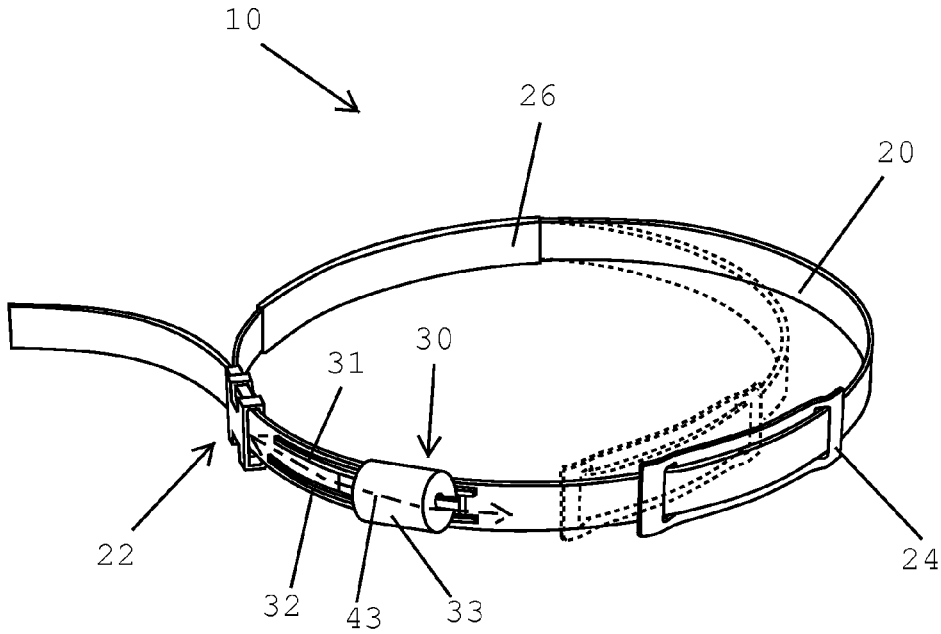
FIG. 4 is a perspective view showing the resilient characteristics of the strap shown in FIG. 1 wherein a toilet paper roll holder is adjustably positioned at an exterior side of the strap.

Referring to the FIGS. 1-4 in general, an outdoor support strap 10 holds a user 50 in a squatted position above the ground surface while defecating. Such an outdoor support strap 10 includes a body 10 formed from flexible and elastic material. Such a body 20 is selectively deformed from a circular non-tensioned shape during non-use (FIGS. 1 and 2) to an oval tensioned shape when the body 20 is simultaneously positioned around a user 50 waist and a tree 40 (FIG. 3). The strap 10 further includes a fastener 22 having selectively mated male 28 and female 27 members attached to opposed ends of the body 20. First and second pads 26 are adjustably attached to unique first and second longitudinal portions 41, 42 of body 20, respectively. The strap 10 also includes a toilet paper roll holder 30 adjustably mated to a unique third longitudinal portion 43 of body 20. In this manner, the first and second pads 24, 26 as well as the toilet paper roll holder 30 are independently and freely displaced along the first, second and third longitudinal portions 41, 42, 43 of body 20.

In a non-limiting exemplary embodiment, the first, second and third longitudinal portions 41, 42, 43 extend along a major circumferential length of body 20 and are mutually exclusive and non-overlapping therealong.

In a non-limiting exemplary embodiment, the toilet paper roll holder 30 includes a lever 34 pivotally engaged with an outer surface of body 20 and releasably locked between open and closed positions when the lever 34 is respectively articulated away and towards the third longitudinal portion 43 of body 20. Thus, the user 50 can freely detach a leading edge of the toilet paper roll 33 while a remaining portion of the toilet paper roll 33 is rotatably anchored to lever 34.

In a non-limiting exemplary embodiment, body 20 further includes flexible first and second rails 31, 32 attached to the outer surface of the third longitudinal portion 43. In this manner, the lever 34 is slidably engaged with the first and second rails 31, 32 such that the lever 34 is reciprocated along an arcuate path defined along the third longitudinal portion 43 of body 20.

In a non-limiting exemplary embodiment, first pad 24 extends beyond top and bottom edges 45, 46 of the first longitudinal portion 41 of body 20 and thereby spans across an entire width of the first longitudinal portion 41 transverse to the circumferential length of body 20.

In a non-limiting exemplary embodiment, the second pad 26 covers an entire surface area of the second longitudinal portion 42 and is diametrically opposed from the first pad 24.

In a non-limiting exemplary embodiment, lever 34 is intermediately positioned between the first and second rails 31, 32. Thus, the lever 34 has a longitudinal length terminating prior to reaching proximal and distal ends of each of the first and second rails 31, 32, respectively.

The present disclosure further describes a method of utilizing an outdoor support strap 10 for holding a user 50 in a squatted position above a ground surface while the user 50 defecates. Such a method includes a plurality of chronological steps. Initially a user 50 obtains a body 20 formed from flexible and elastic material wherein body 20 includes a fastener 22 including selectively mated male 28 and female 27 members attached to opposed ends of body 20, first and second pads 24, 26 adjustably attached to unique first and second longitudinal portions 41, 42 of body 20 respectively, and a toilet paper roll holder 30 adjustably mated to a unique third longitudinal portion 43 of body 20. The first and second pads 24, 26 span across an interior side of body 20 while the toilet paper roll holder 30 remains situated along an exterior side of body 20.

The method further includes the chronological steps of: selectively deforming body 20 from a circular non-tensioned shape during non-use to an oval tensioned shape by simultaneously positioning body 20 around a user 50 waist and a tree 40; independently and freely displacing the first and second pads 24, 26 as well as the toilet paper roll holder 30 along the first, second and third longitudinal portions 41, 42, 43 of body 20; leaning back into a squatted position such that body 20 supports a user 50 buttock region at an elevated position above the ground surface; defecating; leaning forward into an upright position and opening the fastener 22; and removing body 20 from the user 50 waist and the tree 40.

In a non-limiting exemplary embodiment, the flexible and elongated body is preferably formed from an elastic material such that it remains deformably resilient for providing a resistive force against the user's waist. In this manner, the user 50 is able to lean away from the support surface and assume a squatted a position to thereby extend his or her legs forwardly of his or her buttocks. Such a support strap 10 alleviates the strain and energy required to maintain a squatted position for an extended period of time. By using the support strap 10, the user's hands remain free to hold objects or cleanse the buttocks area with toilet paper, for example.

In a non-limiting exemplary embodiment, a buckle (fastener 22) permits the user 50 to selectively adjust an overall length of body 20. A cushioned first pad 24 is attached to the inner wall of body 20. Such a first pad 24 extends beyond the top and bottom edges 45, 46 of body 20 and thereby remains directed abutted against the backside of the user 50. The cushioned pad may be provided with a sleeve that is slidably biased against the circumference of body 20 for allowing the user 50 to selectively displace the cushioned pad as needed. A second pad 26 maybe formed about body 20 as well. Such a second pad 26 is diametrically opposed from first pad 24 and is directly engaged about an outer surface of a tree 40 or other support structure. In this manner, the second pad 26 maintains a frictional contact with a tree 40 and thereby minimizes the undesirably likelihood of sliding during the defecating process.

In use, In a non-limiting exemplary embodiment, the outdoor support strap 10 is simple and straightforward to use. First, the user 50 would place body 20 around a tree 40 or another support structure. Next, the user 50 would snap on the fastener 22 such that the user's waist is contained within body 20. Thus, the user's waist simultaneously engaged against first pad 24 while the second pad 26 engaged against the outer edge of tree 40 or other support structure being used. Next, the user 50 would slightly lean back into a squatted position while being held by body 20. Next, the user 50 would defecate or urinate as desired. Next, the user 50 would lean forward into an upright position, unbuckle the fastener 22 and remove body 20 from around his or her own waist and from around the tree 40. Support strap 10 can now be stored away in the user's backpack or pocket for future use.

While non-limiting exemplary embodiment(s) has/have been described with respect to certain specific embodiment (s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment (s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A method of utilizing an outdoor support strap for holding a user in a squatted position above a ground surface while the user defecates, said method comprising the chronological steps of:

obtaining an outdoor support strap having a longitudinally extending body with an interior face and an exterior face, said body formed of flexible and elastic material, said body including:

a fastener including selectively mated male and female members attached to opposed ends of said body, first and second pads, on the interior face, adjustably attached to unique first and second longitudinal portions of said body respectively, and a toilet paper roll holder, on the exterior face, adjustably mated to a unique third longitudinal portion of said body;

selectively deforming said body from a circular non-tensioned shape during non-use to an oval tensioned shape by simultaneously positioning said body around said user's waist and a tree;

independently and freely displacing said first and second pads along said interior face of said longitudinally extending body and independently and freely displacing said toilet paper roll holder along said exterior face of said longitudinally extending body, such that said first pad can directly contact an outer surface of the tree and said second pad can directly contact a user's waist;

leaning back into a squatted position such that said body supports said user's buttock region at an elevated position above the ground surface while said user's feet remain on the ground surface;

defecating;

leaning forward into an upright position and opening said fastener; and removing said body from the user's waist and the tree.

* * * * *